US006006049A

United States Patent [19]

Folkins

[11] Patent Number: 6,006,049

[45] Date of Patent: Dec. 21, 1999

[54] SWITCHED STANDBY HOUSING BIAS IN READ PRINTERS

[75] Inventor: Jeffrey J. Folkins, Rochester, N.Y.

[73] Assignee: Xerox Corporation, Stamford, Conn.

[21] Appl. No.: 09/184,145

[22] Filed: Nov. 2, 1998

[51] Int. Cl.[6] ..... G03G 15/06

[52] U.S. Cl. ..... 399/55; 399/98; 399/266

[58] Field of Search ..... 399/55, 54, 53, 399/56, 266, 279, 290, 291, 98, 99

[56] References Cited

U.S. PATENT DOCUMENTS

| | | | |
|---|---|---|---|
| 4,868,600 | 9/1989 | Hays et al. | 355/259 |
| 4,984,019 | 1/1991 | Folkins | 355/215 |
| 5,010,367 | 4/1991 | Hays | 355/247 |
| 5,063,875 | 11/1991 | Folkins et al. | 118/651 |

*Primary Examiner*—Arthur T. Grimley
*Assistant Examiner*—Hoan Tran
*Attorney, Agent, or Firm*—John M. Kelly

[57] ABSTRACT

Operation of a developer so as to achieve reduced scavenging and reduced direct contamination when using a hybrid developer. A hybrid developer is operated in three modes. The first mode is normal operation in which the developer operates as in the prior art. The second mode is an unloaded standby mode wherein toner is not on the developer's donor roll and wherein the developer's bias potentials are selected to reduce scavenging. The third mode is a loaded standby mode wherein toner is on the developer's donor roll and wherein the developer's bias potentials are selected to reduce direct contamination.

20 Claims, 2 Drawing Sheets

SWITCHED STANDBY HOUSING BIAS IN READ PRINTERS

FIELD OF THE INVENTION

This invention relates to multiple pass Recharge-Expose-and-Develop (REaD) electrophotographic color printers. In particular it relates to a developer bias control technique for reducing scavenging and direct image contamination.

BACKGROUND OF THE INVENTION

Electrophotographic marking is a well-known and commonly used method of copying or printing documents. Electrophotographic marking is performed by exposing a light image representation of a desired document onto a substantially uniformly charged photoreceptor. In response to that light image the photoreceptor discharges so as to create an electrostatic latent image of the desired document on the photoreceptor's surface. Toner particles are then deposited onto that latent image to form a toner image. That toner image is then transferred from the photoreceptor onto a substrate such as a sheet of paper. The transferred toner image is then fused to the substrate, usually using heat and/or pressure. The surface of the photoreceptor is then cleaned of residual developing material and recharged in preparation for the production of another image.

The foregoing broadly describes a black and white electrophotographic printing machine. Electrophotographic marking can also produce color images by repeating the above process once for each color of toner that is used to make the composite color image. For example, in one color process, referred to herein as the REaD IOI process (Recharge, Expose, and Develop, Image On Image), a charged photoreceptive surface is exposed to a light image which represents a first color, say black. The resulting electrostatic latent image is then developed with black toner particles to produce a black toner image. A recharge, expose, and develop process is repeated for a second color, say yellow, then for a third color, say magenta, and finally for a fourth color, say cyan. The various color toner particles are placed in superimposed registration so that a desired composite color image results. That composite color image is then transferred and fused onto a substrate.

The REaD IOI process can be implemented in a various ways. For example, in a single pass printer wherein the composite image is produced in a single pass of the photoreceptor through the machine. Another implementation is in a four pass printer, wherein one color toner image is produced during each pass of the photoreceptor through the machine, and wherein the composite color image is transferred and fused during the fourth pass. REaD IOI can also be implemented in a five cycle printer, wherein only one color toner image is produced during each pass of the photoreceptor through the machine, but wherein the composite color image is transferred and fused during a fifth pass.

In electrophotographic printing the step of conveying toner onto a latent image is called development. In development, charged toner particles are applied to a latent image such that toner particles electrostatically adhere to the proper areas of the latent image. There are several types of developers. A magnetic brush developer uses a two-component developer material that is comprised of toner particles and magnetic carrier beads. The smaller toner particles triboelectrically adhere to the larger magnetic carrier beads. When the developer material is placed in a magnetic field, the carrier beads and their triboelectrically adhering toner particles form relatively long chains which resemble the fibers of a brush, thus the name magnetic brush developer. When the magnetic brush is introduced into a development zone adjacent the latent image the electrostatic charges of the latent image pull toner particles from the carrier beads and onto the photoreceptor. The magnetic fields are typically created using a "developer roll," a cylindrical sleeve that rotates around a fixed assembly of permanent magnets.

Another developer is the "scavengeless" developer. Scavengeless development is described more fully in, for example, U.S. Pat. No. 4,868,600 to Hays et al., U.S. Pat. No. 4,984,019 to Folkins, U.S. Pat. No. 5,010,367 to Hays, and U.S. Pat. No. 5,063,875 to Folkins et al., and in their citations. In scavengeless development toner particles are conveyed onto a latent image using AC electric fields that are applied to electrode structures, commonly wires, that are positioned between a toner-loaded donor roll and the photoreceptor. Significantly, there is no physical contact between the developer and the photoreceptor.

A variation of the scavengeless developer is the "hybrid" scavengeless developer. A hybrid scavengeless developer includes a developer housing with a toner reservoir, a developer roll, a donor roll, and an electrode structure. The developer roll operates like a developer roll in the magnetic developer, except that instead of conveying toner particles directly onto the photoreceptor the hybrid scavengeless developer roll conveys toner particles onto a donor roll that is disposed between the transport roll and the photoreceptor. The donor roll is electrically biased such that toner particles are attracted from the developer roll. When loaded with toner the donor roll can convey toner particles to the photoreceptor. To do so, the electrode structure is AC-biased relative to the donor roll. The AC bias detaches toner from the donor roll into a toner powder cloud that forms in the gap between the donor roll and the photoreceptor. The latent image then attracts toner particles from the powder cloud, developing the latent image. It should be noted that when the donor roll bias and AC bias are removed the toner on the donor roll tends to leave the donor roll and move toward the developer roll and the toner reservoir.

Hybrid scavengeless development is advantageous in REaD systems because the donor roll acts as an electrostatic "intermediate" between the photoreceptor and the developer roll. This tends to reduce unwanted interactions between the developer and the photoreceptor. While hybrid scavengeless development does reduce unwanted interactions, two specific REaD interactions can still occur: scavenging and direct image contamination. In scavenging, toner on the photoreceptor is pulled off the photoreceptor and into a developer. This causes contamination of the toner in the developer. In direct image contamination, toner within a developer is attracted onto the photoreceptor where it is not wanted.

Both scavenging and direct image contamination are products of potential differences between the developer and the photoreceptor. Consider a photoreceptor having a toner layer after the image area and its toner have been uniformly recharged to −500V. Assuming a donor roll at +100 volts, toner particles on the image area are attracted into the developer housing, resulting in scavenging. Now consider a photoreceptor having a developed toner layer that has not been recharged. The toner particles might be at about −200V. Assuming a donor roll at −400 volts, toner particles are attracted from the donor roll onto the toner layer, resulting in direct contamination (even if the AC bias is removed from the developer electrode). While it is possible to set the donor roll bias at a potential that tends to balance scavenging and direct contamination, some scavenging and some direct contamination will then occur at all times.

In some REaD IOI systems a developer's donor roll is loaded with toner just before that developer develops its toner image. After development the toner on the donor roll is then returned to the toner reservoir. Since direct contamination is only a problem when toner is on the donor roll, direct contamination will not occur until the donor roll is loaded with toner.

In view of the detrimental effects of scavenging and direct contamination, and in view of their competing natures, a technique of reducing both would be beneficial.

SUMMARY OF THE INVENTION

This invention provides for a technique of reducing both scavenging and direct contamination when using a hybrid scavengeless developer. According to the principles of the present invention developer is operated with three modes. The first mode is normal operation in which the developer operates as in the prior art. The second mode is an unloaded standby mode wherein toner is not on the developer's donor roll and wherein the developer's bias potentials are selected to reduce scavenging. The third mode is a loaded standby mode wherein toner is on the developer's donor roll and wherein the developer's bias potentials are selected to reduce direct contamination.

BRIEF DESCRIPTION OF THE DRAWINGS

Other aspects of the present invention will become apparent as the following description proceeds and upon reference to.

DETAILED DESCRIPTION OF A PREFERRED EMBODIMENT OF THE INVENTION

Figure 1:
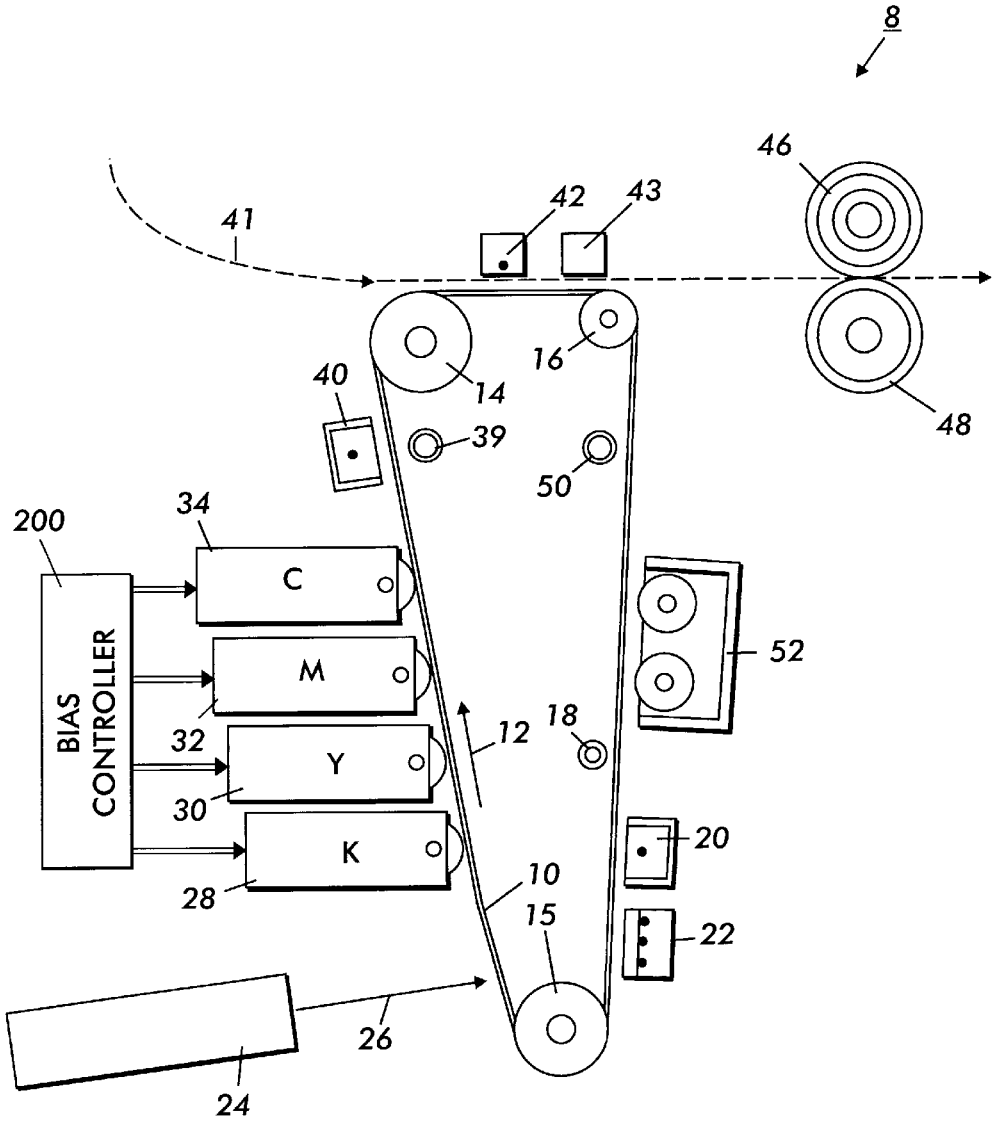
FIG. 1, which schematically illustrates an electrophotographic printing machine that incorporates the principles of the present invention.

Referring now to FIG. 1, the preferred embodiment of the present invention is an electrophotographic, multipass Recharge-Expose-and-Develop (REaD) Image-on-Image (IOI) printing machine 8 that uses hybrid scavengeless developers having controlled biases. The printing machine 8 includes an Active Matrix (AMAT) photoreceptor 10 which travels in the direction indicated by the arrow 12. Photoreceptor travel is brought about by mounting the photoreceptor about a drive roller 14 (that is driven by a motor that is not shown) and tension rollers 15 and 16.

As the photoreceptor travels each part of it passes through each of the subsequently described processing stations. For convenience, a single section of the photoreceptor, referred to as the image area, is identified. The image area is that part of the photoreceptor which is to receive the various toner layers which, after being transferred and fused to a substrate, produce the final color image. While the photoreceptor may have one or many image areas, since each image area is processed in the same way a description of the processing of one image area suffices to fully explain the operation of the printing machine.

The production of a color document takes place in 4 cycles. The first cycle begins with the image area passing a "precharge" erase lamp 18 that illuminates the image area so as to cause any residual charge which might exist on the image area to be discharged. Such erase lamps are common in high quality systems and their use for initial erasure is well known.

As the photoreceptor belt continues its travel the image area passes through a charging station consisting of a DC scorotron 20 and an AC scorotron 22. To prepare the image area for exposure to create a latent image for black toner (which is the first toner deposited on the photoreceptor) the DC scorotron charges the image area to a substantially uniform potential of, for example, about −500 volts. During this initial charging the AC scorotron 22 need not be used. It should be understood that the actual charge placed on the photoreceptor depends upon many variables, such as black toner mass and the settings of the black development station.

After passing the charging station the image area advances until it reaches an exposure station 24. At the exposure station the charged image area is exposed to a modulated laser beam 26 that raster scans the image area such that an electrostatic latent representation of a black image is produced. For example, illuminated sections of the image area might be discharged by the laser beam 26 to about −50 volts. Thus after exposure the image area has a voltage profile comprised of relatively high voltage areas of about −500 volts and of relatively low voltage areas of about −50 volts.

After passing the exposure station 24 the exposed image area passes a black development station 28 which deposits negatively charged black toner particles onto the exposed portions of the image area but not on the non-illuminated portions.

The black development station 28 is a hybrid scavengeless developer. The principles of the present invention are directly related to controlling the bias potentials of hybrid scavengeless developers. Those bias potentials are selectively controlled by a bias controller 200 so as to operate the developer in various modes of operation. Bias potential control is explained in more detail subsequently. However, at this time it is to be understood that the potentials required to operate each developer, including the AC electrode voltages and any required developer roll potentials, are controlled as required to develop the image area.

After passing the black development station the image area advances past a number of other stations whose purposes are described subsequently and returns to the precharge erase lamp 18. The second cycle then begins.

Numerous schemes for recharging the image area and its black toner layer are possible. One method is to use the precharge erase lamp 18 to expose the photoreceptor so as to reduce the charge on the unexposed areas of the image area. Then, the DC scorotron 20 recharges the image area to the charge level desired for exposure and development of the yellow image. Here, the AC scorotron 22 is not used.

The recharged image area with its black toner layer then advances to the exposure station 24. That exposure station exposes the image area with the laser beam 26 so as to produce an electrostatic latent representation of a yellow image. As an example of the charges on the image area, the non-illuminated parts of the image area might have a potential about −450 while the illuminated areas are discharged to about −50 volts.

After passing the exposure station 24 the now exposed image area advances past a yellow development station 30 that deposits yellow toner onto the image area. The yellow development station is also a hybrid scavengeless developer that has its bias potentials selectively controlled by the bias controller 200.

After passing the yellow development station, the image area and its toner layers advance past the precharge exposure lamp and the third cycle begins. During the third (and fourth) cycle the charging stations implement split recharging. In split recharging the DC scorotron 20 overcharges the image area and its toner layers to a more negative potential than that which the image area and its toner layers are to have when they are next exposed. The AC scorotron 22 then reduces the charge levels to the desired level.

After passing the AC scorotron 22 the substantially uniformly charged image area with its toner layers then advances once again to the exposure station 24. The exposure station again exposes the image area using the laser beam 26, this time with a light representation that discharges some parts of the image area to create an electrostatic latent representation of a magenta image.

The image area then advances through a magenta development station 32. The magenta development station, again a hybrid scavengeless developer that has its bias potentials selectively controlled by the bias controller 200, advances magenta toner onto the image area. The result is a third toner layer on the image area.

The image area with its toner layers then advances past the precharge erase lamp to the charging station. The fourth cycle then begins. The DC scorotron 20 and the AC scorotron 22 again split recharge the image area (which now has three toner layers) to produce the desired charge on the photoreceptor.

The substantially uniformly charged image area with its toner layers then advances once again to the exposure station 24. The exposure station exposes the image area with the laser beam 26, this time with a light representation that discharges some parts of the image area to create an electrostatic latent representation of a cyan image. After passing the exposure station the image area passes a cyan development station 34. The cyan development station, also a hybrid scavengeless developer that has its bias potentials selectively controlled by the bias controller 200, advances cyan toner onto the image area.

After passing the cyan development station the image area has four toner layers which together make up a composite color toner image. That composite color toner image is comprised of individual toner particles that have charge potentials that vary widely. Indeed, some of those particles might have a positive charge. Transferring such a composite toner image onto a substrate would result in a degraded final image. Therefore it is beneficial to prepare the composite color toner image for transfer.

To prepare for transfer a pretransfer erase lamp 39 discharges the image area to produce a relatively low charge level on the photoreceptor. The image area then passes a scorotron 40 that performs a pre-transfer charging function by supplying sufficient negative ions to the image area such that substantially all of the previously positively charged toner particles are reversed in polarity.

The image area continues to advance in the direction 12 past the driven roller 15. A substrate 41 is then placed over the image area using a sheet feeder (which is not shown). As the image area and substrate continue their travel they pass a transfer corotron 42. That corotron applies positive ions onto back of the substrate 41. Those ions attract the negatively charged toner particles onto the substrate.

As the substrate continues its travel is passes a detack corotron 43. That corotron neutralizes some of the charge on the substrate to assist separation of the substrate from the photoreceptor 10. As the lip of the substrate moves around the tension roller 16 the lip separates from the photoreceptor. The substrate is then directed into a fuser where a heated fuser roller 46 and a pressure roller 48 create a nip through which the substrate 41 passes. The combination of pressure and heat at the nip causes the composite color toner image to fuse into the substrate. After fusing, a chute, not shown, guides the substrate to a catch tray, also not shown, for removal by an operator.

After the substrate is separated from the photoreceptor belt 10 the image area continues its travel and passes a preclean erase lamp 50. That lamp neutralizes most of the charge remaining on the photoreceptor belt. After passing the preclean erase lamp the residual toner and/or debris on the photoreceptor is removed at a cleaning station 52. At the cleaning station cleaning brushes wipe residual toner particles from the image area. This marks the end of the print cycles. The image area then passes once again to the precharge erase lamp and the start of another 4 cycles.

Figure 2:
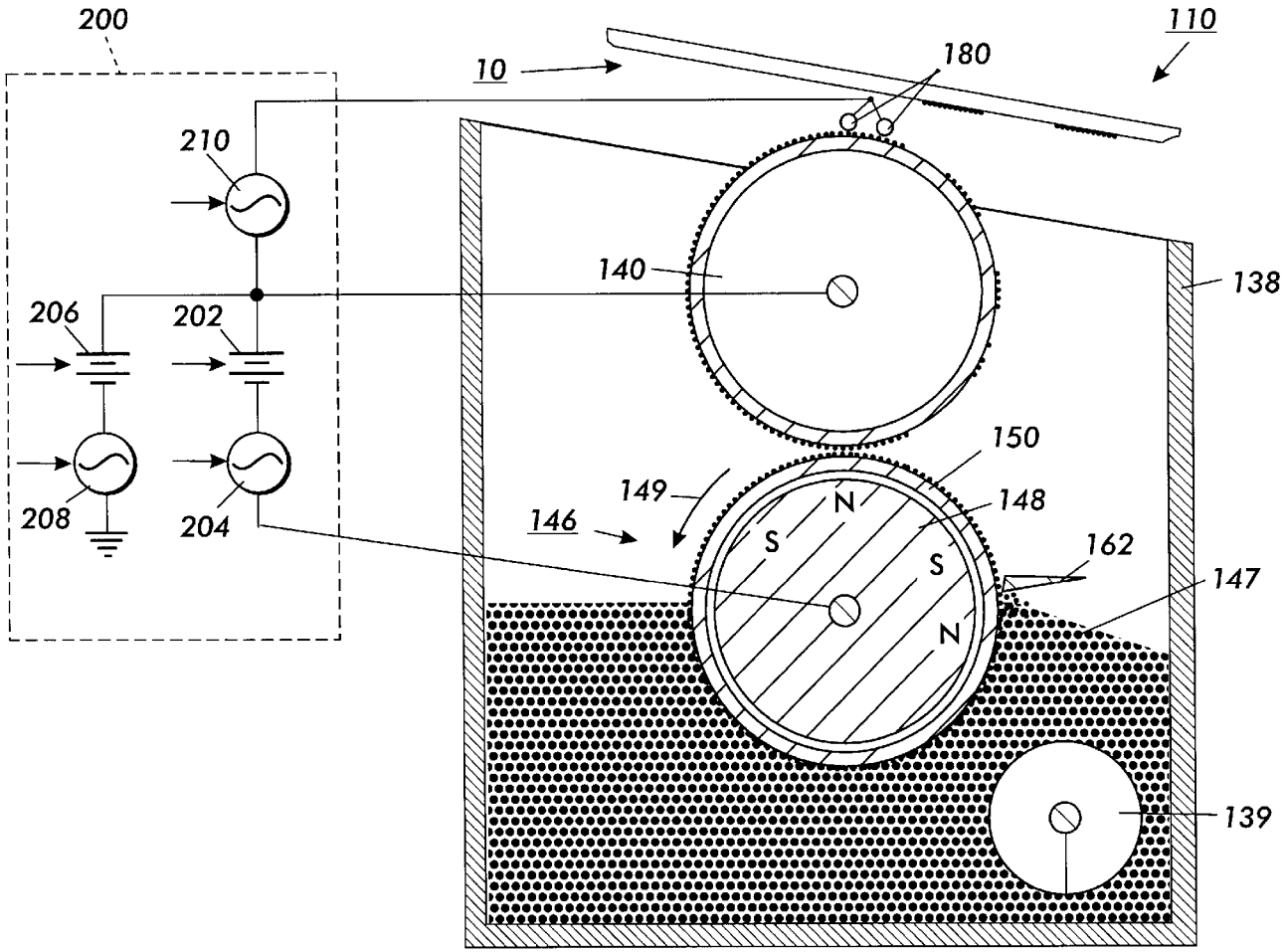
FIG. 2, which illustrates a hybrid scavengeless developer having controlled donor roll bias and that is used in the printing machine illustrated in FIG. 1.

The principles of the present invention directly relate to the operation of the developers 28, 30, 32, and 34. FIG. 2 illustrates a generic developer 110, which generically represents each of the developers 28, 30, 32, and 34, and the bias controller 200, in more detail. The developer 110 includes a housing 138 that defines a reservoir for storing a two part (toner particles and carrier particles) toner 147. At the bottom of the housing 138 is a horizontal auger 139 that distributes toner uniformly along a developer roll 146. The lowermost part of the developer roll is immersed in the toner. The developer roll 146 comprises a stationary multipolar magnet assembly 148 having a closely spaced sleeve 150 of non-magnetic material, preferably aluminum, that is designed to be rotated about the magnetic assembly 148 in a direction that is indicated by the arrow 149. Because the toner 147 includes magnetic carrier particles, as the sleeve rotates the toner is attracted to the exterior of the sleeve. A doctor blade 162 limits the radial extent of the toner.

The developer 110 also includes a donor roll 140 and thin, steel electrode wires 180. The electrode wires are disposed between the photoreceptor 10 and the donor roll 140 and extend along the axis of the donor roll. If the donor roll is properly biased a thin layer of toner particles is attracted from the developer roll 146 onto the surface of donor roll. However, the donor roll can also be biased such that toner is removed from the donor roll and returned to the developer roll and into the toner reservoir. If the donor roll has toner, an AC voltage applied to the electrode wires 180 cases a cloud of toner particles to form between the photoreceptor 10 and the donor roll. Potentials on the photoreceptor can then draw toner particles from the toner cloud onto the photoreceptor to form a toner image.

The bias controller 200 selectively supplies electrical power to the developer 110 so as to operate in three distinct modes. Since the actual voltages used will depend upon many factors, such as the photoreceptor potentials, the particular characteristics of the toner being transferred, the physical construction of the developer, and humidity, the actual voltages given below when discussing those modes of operation are illustrative only.

Still referring to FIG. 2, the potential difference between the donor roll 140 and the developer roller has both a DC component, set by a DC supply 202, and an AC component, set by an AC supply 204. If the donor roll is, or is being, loaded with toner the bias controller 200 sets the DC supply 202 to attract toner onto the donor roll, say about +50 Volts. A thin layer of toner particles is then attracted from the developer roll 146 onto the surface of donor roll. However, if the donor roll is not loaded with toner, or if toner is being returned to the developer roll, the bias controller sets the DC supply 202 at a level that returns toner, say −50 volts. The AC supply 204 is beneficial left at a predetermined value, say at about 300 Volt peak-to-peak with a frequency of 2.5 kHz.

The potential difference between the donor roll 140 and a system ground also has a DC component, set by a DC supply 206, and an AC component, set by an AC supply 208. Furthermore, the electrode wires 180 are selectively AC biased relative to the donor roll by an AC supply 210.

As mentioned above, the bias controller 200 operates the developer 110 with three distinct modes of operation. Those modes are a run mode, unloaded standby mode, and a loaded standby mode. During the run mode the bias controller 200 controls the developer 110 as in the prior art. For example, the DC supply 202 is set to load toner onto the donor roll (+50V), the AC supply 204 runs with its operating voltage (300 Volt peak-to-peak with a frequency of 2.5 kHz). Furthermore, the DC supply 206, the AC supply 208, and the AC supply 210 are set to produce a toner cloud (potentials around −220 to −500 V DC, 300 Volts peak-to-peak, and 850 Volts peak-to-peak, respectively).

However, when toner is not required on the donor roll, which is usually the case when other developers are developing latent images, the bias controller 200 sets the developer 110 to an unloaded standby mode. In that mode the DC supply 202 is set to return toner 147 to the developer roll 146 (−50 Volts) and the potentials on the electrode wires 180 are removed (AC supply 210 is turned off). In response, the donor roll toner is returned to the developer housing 138 and the toner cloud collapses. With no toner on the donor roll direct contamination is prevented. The bias potential of the DC supply 206 is then set to reduce scavenging. For example, the DC supply 206 potential might be set to about −200 volts. Significantly, in the unloaded standby mode the bias potentials are set to prevent scavenging. This is possible because direct contamination is not a problem when the donor roll is not loaded with toner.

While toner is usually not required on the donor roll when other developers are developing latent images, the developer 110 must be prepared to deposit toner when needed. That means that the donor roll must be loaded with toner before a return to the run mode of operation. To do this the bias controller 200 causes the developer 110 to enter the loaded standby mode. In this mode toner is loaded onto the donor roll 140 by setting the DC supply 202 to the appropriate value (+50). However, potentials on the electrode wires 180 remain removed (AC supply 210 is turned off). Toner is then loaded onto the donor roll and thus direct contamination becomes a problem. To reduce direction contamination, in the loaded standby mode the DC supply 206 is reduced in potential (to say −50 V) to optimize potentials to avoid direct contamination. While direct contamination is avoided, scavenging then becomes a problem.

While scavenging is a problem in the loaded standby mode, by limiting the time in that mode scavenging is reduced. Indeed, in practice scavenging can be significantly reduced over a comparable machine in which the unloaded standby mode is not used. For example, it is anticipated that in some machines about 89% of the time in standby can be spent in the unloaded standby mode. This means that scavenging is only a problem 11% of the standby time.

It is to be understood that while the figures and the above description illustrate the present invention, they are exemplary only. For example, instead of negatively biasing the photoreceptor, a positively biased photoreceptor might be used. Furthermore, although this invention has been described in connection with a hybrid scavengeless system, the principles of the present invention are also applicable to other hybrid development systems. Others who are skilled in the applicable arts will recognize numerous modifications and adaptations of the illustrated embodiments that will remain within the principles of the present invention. Therefore, the present invention is to be limited only by the appended claims.

What is claimed:

1. A printing machine, comprising:

a charged photoreceptor rotating in a predetermined direction;

an exposure station for exposing said charged photoreceptor to produce a latent image;

a hybrid developer adjacent said charged photoreceptor, said hybrid developer for selectively depositing a toner on said latent image so as to form a toner layer, said hybrid developer including a housing for holding said toner, a developer roll, and a donor roll; and a bias controller for setting a donor bias on said donor roll and for setting a developer bias between said donor roll and said developer roll;

wherein said bias controller controls said donor bias and said developer bias when said latent image passes said hybrid developer such that said toner is deposited on said latent image;

wherein said bias controller controls said donor bias and said developer bias after said latent image has passed said hybrid developer such that said toner is moved from said donor roll to said developer roll so as to reduce scavenging from said charged photoreceptor; and wherein said bias controller controls said donor bias and said developer bias before said latent image reaches said hybrid developer such that said developer bias loads said donor roll with said toner and such that said donor bias inhibits direct contamination of said charged photoreceptor.

2. A printing machine according to claim 1, wherein said hybrid developer further includes electrodes disposed between said donor roll and said charged photoreceptor, and wherein said bias controller selectively applies an AC bias to said electrodes to induce toner deposition on said latent image.

3. A printing machine according to claim 2, wherein said AC bias is reduced after said latent image has passed said hybrid developer.

4. A printing machine according to claim 1, wherein said developer bias includes an AC component.

5. A printing machine according to claim 1, wherein said donor bias includes an AC component.

6. A printing machine, comprising:

a charged photoreceptor rotating in a predetermined direction;

an exposure station for producing a first latent image and a second latent image on said charged photoreceptor, wherein said first latent image is produced before said second latent image;

a first hybrid scavengeless developer adjacent said charged photoreceptor, said first hybrid scavengeless developer for selectively depositing a first toner on said first latent image so as to form a first toner layer, said first hybrid scavengeless developer including a first housing for holding said first toner, a first developer roll, a first donor roll, and first electrode wires;

a second hybrid scavengeless developer adjacent said charged photoreceptor, said second hybrid scavengeless developer for selectively depositing a second toner on said second latent image so as to form a second toner layer, said second hybrid scavengeless developer including a second housing for holding said second toner, a second developer roll, a second donor roll, and second electrode wires;

a bias controller for setting a first donor bias on said first donor roll, for setting a first developer bias between said first developer roll and said first donor roll, and for setting a first electrode bias between said first electrode wires and said first donor roll;

wherein said bias controller controls said first donor bias, said first developer bias, and said first electrode bias when said first latent image passes said first hybrid scavengeless developer such that said first toner is deposited on said first latent image, thereby forming said first toner image;

wherein said bias controller controls said first donor bias and said first developer bias after said first latent image has passed said first hybrid scavengeless developer such that said first toner is moved from said first donor roll to said first developer roll so as to reduce scavenging from said charged photoreceptor; and wherein said bias controller controls said first donor bias and said first developer bias before said first latent image reaches said first hybrid scavengeless developer such that said first developer bias loads said first donor roll with said first toner and such that said first donor bias inhibits direct contamination of said second toner layer.

7. A printing machine according to claim 6, wherein said bias controller also sets a second donor bias on said second donor roll, sets a second developer bias between said second developer roll and said second donor roll, and a second electrode bias between said second electrode wires and said second donor roll;

wherein said bias controller controls said second donor bias, said second developer bias, and said second electrode bias when said second latent image passes said second hybrid scavengeless developer such that said second toner layer is deposited on said second latent image, thereby forming said second toner image;

wherein said bias controller controls said second donor bias and said second developer bias after said second latent image has passed said second hybrid scavengeless developer such that said second toner is moved from said second donor roll to said second developer roll so as to reduce scavenging from said charged photoreceptor; and wherein said bias controller controls said second donor bias and said second developer bias before said second latent image reaches said second hybrid scavengeless developer such that said second developer bias loads said second donor roll with said second toner and such that said second donor bias inhibits direct contamination of said first latent image.

8. A printing machine according to claim 6, wherein said first electrode bias includes an AC potential.

9. A printing machine according to claim 8, wherein said first electrode bias is reduced after said first latent image has passed said first hybrid scavengeless developer.

10. A printing machine according to claim 6, wherein said first developer bias includes an AC component.

11. A printing machine according to claim 6, wherein said first donor bias includes an AC component.

12. A color printing machine, comprising:

a charged photoreceptor rotating in a predetermined direction;

an exposure station for exposing said photoreceptor to produce a first latent image, a second latent image, a third latent image, and a fourth latent image;

a first hybrid scavengeless developer adjacent said charged photoreceptor, said hybrid scavengeless developer for selectively depositing a first toner on said first latent image so as to form a first toner layer, said first hybrid scavengeless developer including a first housing for holding said first toner, a first developer roll, a first donor roll, and first electrode wires;

a second hybrid scavengeless developer adjacent said charged photoreceptor, said hybrid scavengeless developer for selectively depositing a second toner on said second latent image so as to form a second toner layer, said second hybrid scavengeless developer including a second housing for holding said second toner, a second developer roll, a second donor roll, and second electrode wires;

a third hybrid scavengeless developer adjacent said charged photoreceptor, said hybrid scavengeless developer for selectively depositing a third toner on said third latent image so as to form a third toner layer, said third hybrid scavengeless developer including a third housing for holding said third toner, a third developer roll, a third donor roll, and third electrode wires;

a fourth hybrid scavengeless developer adjacent said charged photoreceptor, said hybrid scavengeless developer for selectively depositing a fourth toner on said fourth latent image so as to form a fourth toner layer, said fourth hybrid scavengeless developer including a fourth housing for holding said fourth toner, a fourth developer roll, a fourth donor roll, and fourth electrode wires;

a bias controller for setting a first donor bias on said first donor roll, for setting a first developer bias between said first developer roll and said first donor roll, and for setting said for setting a first electrode bias between said first electrode wires and said first donor roll;

wherein said bias controller controls said first donor bias, said first developer bias, and said first electrode bias when said first latent image passes said first hybrid scavengeless developer such that said first toner layer is deposited on said first latent image, thereby forming said first toner image;

wherein said bias controller controls said first donor bias and said first developer bias after said first latent image has passed said first hybrid scavengeless developer such that toner is moved from said first donor roll to said first developer roll so as to reduce scavenging from said charged photoreceptor; and wherein said bias controller controls said first donor bias and said first developer bias before said first latent image reaches said first hybrid scavengeless developer such that said first developer bias loads said first donor roll with said first toner and such that said first donor bias inhibits direct contamination of said first toner on said second latent image.

13. A color printing machine according to claim 12, wherein said bias controller also sets a second donor on said second donor roll, a second developer bias between said second donor roll and said second developer roll, and a second electrode bias between said second electrode wires and said second donor roll;

wherein said bias controller controls said second donor bias, said second developer bias, and said second electrode bias when said second latent image passes said second hybrid scavengeless developer such that said second toner layer is deposited on said second latent image, thereby forming a second toner image;

wherein said bias controller controls said second donor bias and said second developer bias after said second latent image has passed said second hybrid scavengeless developer such that said second toner is moved from said second donor roll to said second developer roll so as to reduce scavenging from said charged photoreceptor; and wherein said bias controller controls said second donor bias and said second developer bias before said second latent image reaches said second hybrid scavengeless developer such that said second developer bias loads said second donor roll with said second toner and such that said second donor roll inhibits direct contamination of said first latent image.

14. A color printing machine according to claim 12, wherein said first electrode bias includes an AC potential.

15. A color printing machine according to claim 14, wherein said first electrode bias is reduced after said first latent image has passed said first hybrid scavengeless developer.

16. A color printing machine according to claim 12, wherein said first developer bias includes an AC component.

17. A color printing machine according to claim 12, wherein said first donor bias includes an AC component.

18. A color printing machine according to claim 12, further including a transfer station for transferring said first toner layer, said second toner layer, said third toner layer, and said fourth toner layer onto a substrate.

19. A color printing machine according to claim 18, further including a cleaning station for removing residual toner and debris from said charged photoreceptor.

20. A color printing machine according to claim 19, further including a charging station for recharging said charged photoreceptor.

* * * * *